US005762184A

United States Patent [19]

Greiner

[11] Patent Number: 5,762,184

[45] Date of Patent: Jun. 9, 1998

[54] JEWELRY HOLDER WITH AT LEAST ONE MOVABLE STAND

[76] Inventor: Lori Greiner, 1430 N. Astor St., Chicago, Ill. 60610

[21] Appl. No.: 665,734

[22] Filed: Jun. 14, 1996

[51] Int. Cl.[6] ..... B65D 85/00; A47B 81/00

[52] U.S. Cl. ..... 206/6.1; 211/85.2; 312/107

[58] Field of Search ..... 206/6.1, 566; 211/13, 211/86, 113, 123, 124, 189, 206, 85.2; 248/163.1, 165; 312/108, 128, 237, 240, 280, 107

[56] References Cited

U.S. PATENT DOCUMENTS

| | | | |
|---|---|---|---|
| D. 194,466 | 1/1963 | Johnson . | |
| D. 197,252 | 12/1963 | Spears . | |
| D. 277,340 | 1/1985 | Christen . | |
| D. 303,999 | 10/1989 | Hansson . | |
| D. 315,460 | 3/1991 | Sorce, Jr. . | |
| 540,206 | 5/1895 | Brooks | 312/237 |
| 948,377 | 2/1910 | Prouty | 312/280 |
| 2,760,647 | 8/1956 | Saul, Jr. | 211/13 |
| 3,351,401 | 11/1967 | Cohen | 312/280 |
| 3,847,458 | 11/1974 | Nowak | 312/108 |
| 4,088,380 | 5/1978 | Watts | 312/237 |
| 4,116,509 | 9/1978 | Smith | 312/280 |
| 4,396,121 | 8/1983 | Lemmon | 206/6.1 |
| 4,775,053 | 10/1988 | Geiger | 211/13 |
| 4,819,814 | 4/1989 | Fogelgren | 312/108 |
| 5,067,617 | 11/1991 | Caldwell et al. | 211/13 |
| 5,117,971 | 6/1992 | Fisher | 206/6.1 |

OTHER PUBLICATIONS

Advertisement from "Home Organization," pp. 33–36 (date unknown).

Advertisement, "Ear–It–Is!," two pages (date unknown).

Advertisement, "Jewelry Rack," from Paragon Catalog Exclusive, one page (date known).

Advertisement, "Celestial Organizer," one page (date known).

Advertisement, "Heirloom Cherry' Jewelry Armoire," one page (date known).

Advertisement showing 6 jewelry boxes, one page (date known).

Copy of a photograph of 3 jewelry boxes.

*Primary Examiner*—Jimmy G. Foster

*Attorney, Agent, or Firm*—Brinks Hofer Gilson & Lione

[57] ABSTRACT

A jewelry holder with at least one self-standing removable stand, the holder having a base and at least one removable holder wherein the holder has at least one crosspiece with at least one aperture for receiving a portion of an earring. The base may be in the form of a box with a slidable drawer.

9 Claims, 2 Drawing Sheets

FIG. 1
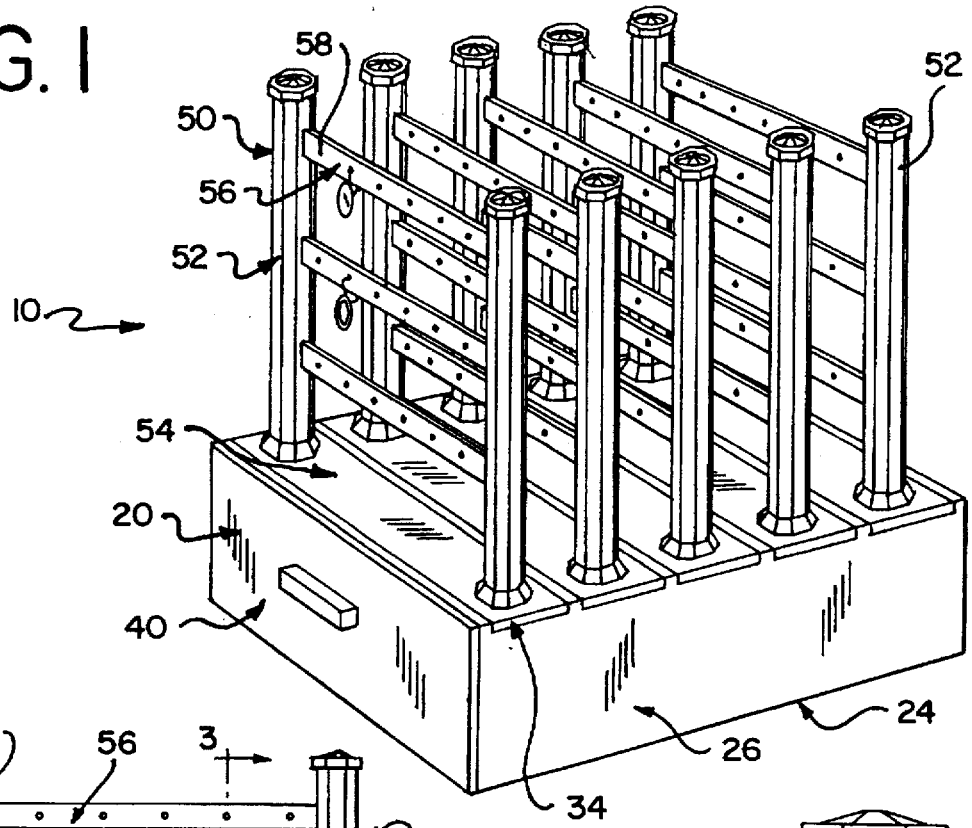
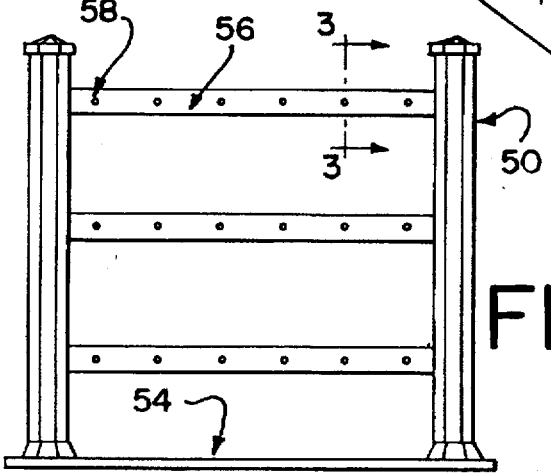
FIG. 2
FIG. 3
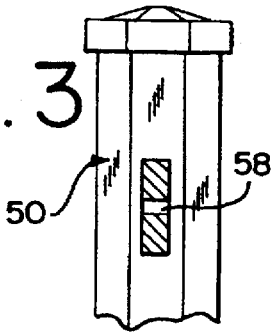
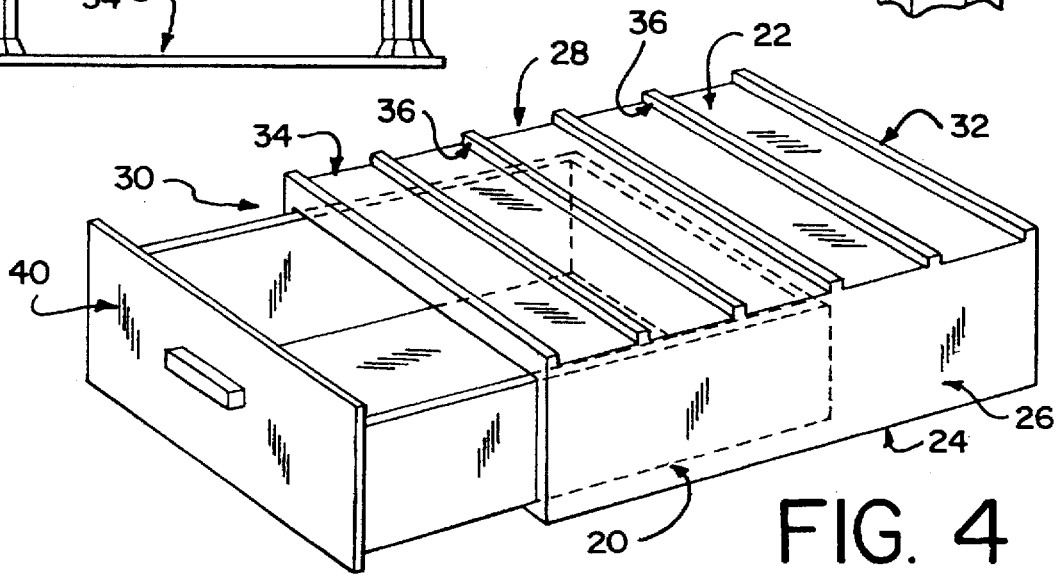
FIG. 4

FIG. 5
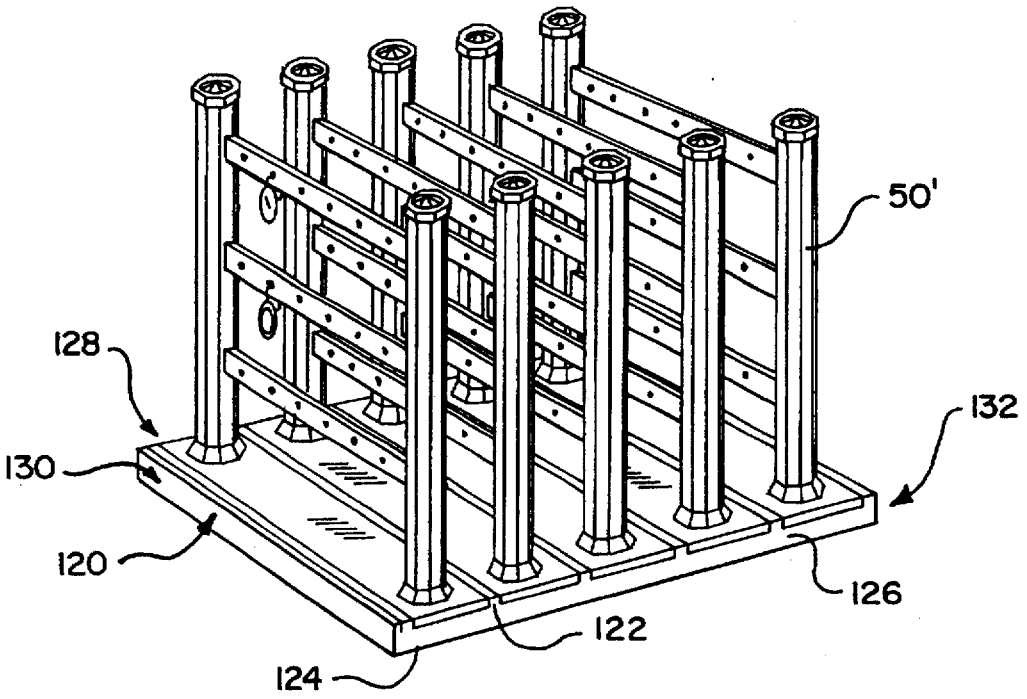
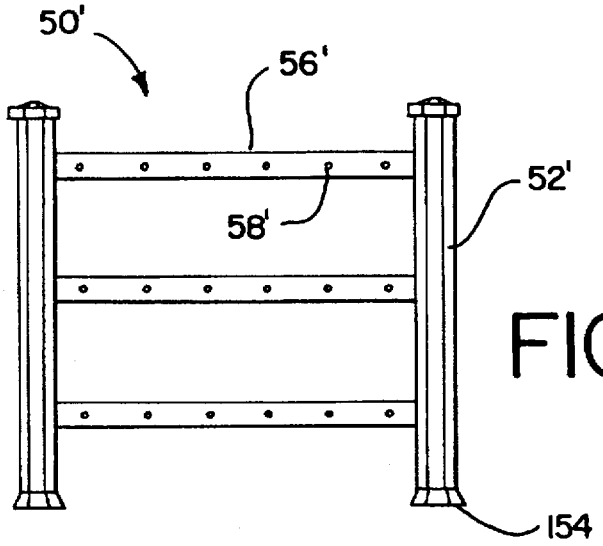
FIG. 6

JEWELRY HOLDER WITH AT LEAST ONE MOVABLE STAND

BACKGROUND OF THE INVENTION

The present invention relates to a jewelry holder with at least one movable stand. While several different kinds of jewelry holders are known, there is a need for a jewelry holder that is simple to manufacture yet provides easy access to the jewelry.

One type of jewelry holder is in the form of a container with relatively high side and back walls and a top that is hinged to the back wall to permit access into the container. Earring stands are fixed to the bottom of the container. A particular problem with this type of earring holder is that it is very difficult to insert and remove the jewelry from the stands because the side walls and hinged top limit the amount of space available.

To solve that problem, it has been proposed to provide an earring rack on a base. The rack has legs that fit within holes provided in the base. A particular disadvantage to this type of jewelry holder is that the stand, if removed from the base, cannot be placed on a table, dresser top, or similar horizontal surface without falling over.

Yet another type of jewelry holder proposes racks that slide into a box-like container having a single open side. Again, a problem with this type of jewelry holder is that because the racks are designed as an integral part of the box-like container when the racks are removed from the container, the rack cannot be placed on a horizontal surface without falling over. In addition, because there is only one open side, access to the jewelry is difficult.

SUMMARY OF THE INVENTION

The present invention provides a jewelry holder with at least one movable stand. In the most preferred embodiment, the jewelry holder of the present invention includes a plurality of earing stands removably positioned on a base that includes a slidable drawer. The base is in the form of a box with an open front that slidably receives a drawer. The top of the base is provided with at least one groove to slidably receive at least one stand. Preferably, the top of the base has a plurality of spaced apart and parallel grooves with each groove adapted to slidably receive a stand. Thus, in this preferred embodiment, a plurality of stands are provided so that each groove receives at least one stand.

The stand in this most preferred embodiment includes a pair of supports joined by a substantially horizontal crosspiece that has at least one aperture sized to receive a post or stem of an earring. The stand includes a base that is sized to slidably fit within the grooves in the base. Preferably, the stand includes a plurality of spaced apart substantially parallel and horizontal crosspieces that join the supports. Each crosspiece has a plurality of apertures, with each sized to slidably receive an earring. Alternatively, for clip-on earrings they may be clipped on the crosspiece.

In an alternative embodiment, the top of the base has a plurality of depressions suitably sized to receive the base of each support. In yet another embodiment, the base does not have an open front; rather it is in the form of a slab and may have either the grooves or the depressions described above.

BRIEF DESCRIPTION OF THE DRAWINGS

FIG. 1 is a perspective view of the preferred embodiment of the jewelry holder with at least one movable stand of the present invention.

FIG. 2 is a front view of a stand that has been removed from the base of the jewelry holder of FIG. 1.

FIG. 3 is a cross-sectional view of a portion of the stand shown in FIG. 2 taken along line 3—3.

FIG. 4 is a perspective view of the base of the jewelry holder of FIG. 1 with each of the stands removed and the drawer partially open.

FIG. 5 is a perspective view of an alternative embodiment of the base, wherein the base is in the form of a slab.

FIG. 6 is a front view of an alternative embodiment of a stand that may be used on a base having a plurality of depressions as well as on the base shown in FIGS. 2 and 5.

DETAILED DESCRIPTION OF THE INVENTION AND PREFERRED EMBODIMENTS

In accordance with a preferred embodiment, the jewelry holder with at least one movable stand 10 includes a base 20 and at least one stand 50. The stand has at least one crosspiece 56 with at least one aperture 58 that can slidably receive a post or stem of an earring. In addition, the stand 50 can be removed from the base 20 to permit the earrings to be easily viewed and accessed.

Referring now to FIGS. 1–4, the most preferred embodiment of the present invention is shown. Turning to FIGS. 1 and 4, the jewelry holder 10 includes a base 20 in the form of an open box having a top 22 opposite and spaced from a bottom 24, a first side 26 joining the top and bottom and a second side 28 opposite the first side and also joining the top and bottom. The box also includes an open front 30 and a rear 32 opposite the front and substantially normal to the first and second sides and joining the top with the bottom. In this most preferred embodiment, the open front slidably receives a drawer 40 which can be used to store jewelry and other objects.

In an alternative embodiment as best seen in FIG. 5, the base 120 is in the form of a slab having a top 122 and a bottom 124, a first side 126 and a second side 128 opposite the first side, and a front 130 and a rear 132 opposite the front and substantially normal to the first and second sides.

The base (20, 120) receives at least one stand 50 and, preferably a plurality of stands. Referring to FIGS. 1 and 4, it can be seen that the base includes at least one and, preferably a plurality of spaced apart grooves 34 that are sized to slidably receive a stand 50. The grooves 34 may slidably receive a stand 50 in either of two directions: from the side or from the top. The grooves 34 may extend at least a portion from either the first or second side to the opposite side. Alternatively, the grooves may extend at least a portion from either the front or the rear to the opposite end. Where more than one groove is provided, they are oriented parallel to each other. The grooves may be provided in any suitable manner and, as shown in FIG. 4 may be provided by orienting ridges 36 in a spaced apart fashion parallel to each other.

As best seen in FIGS. 1 and 2, each stand 50 includes a pair of spaced apart supports 52 connected by at least one and preferably by a plurality of crosspieces 56. In a preferred embodiment each crosspiece 56 has at least one and preferably a plurality of apertures 58 having a size suitable to receive a post or stem of an earring. Clip-on type earring of course can be clipped directly on the crosspiece. In this way an earring can be easily stored on the crosspiece 56. In the most preferred embodiment, each stand 50 includes a plurality of spaced apart parallel crosspieces 56 that are horizontally oriented to connect the supports. In the most preferred embodiment, each crosspiece 56 includes a plurality of spaced apart apertures 58 so that a number of earrings may be stored on each stand. Alternatively the crosspiece 56 need not have apertures in which case only clip-on type earring could be mounted on the crosspiece.

To permit simple and easy viewing access to stored earrings, the stands 50 are provided with a base 54 that is shaped and sized to permit slidable removal from the base 20 and, in particular, slidable removal from the grooves 36. In this way, when it is desired to store one or more earrings or to view and remove one or more earrings, the stand 50 may be slidably removed from the base (20, 120). The stand 50, when removed from the base (20, 120), is self-supporting. The stand 50 may be slidably removed in either of two directions: from the top or from the side. As shown in FIG. 2, the base 54 of the stand 50 may extend from one support 52 to the other and thus provide a more stable structure for the stand, especially when the stand is removed from the base (20, 120). Alternatively, as best seen in FIG. 6, the base 154 of the stand may simply be provided at the foot of each support. When the base 154 of the stand is provided in this manner (i.e, as shown in FIG. 6) it will be understood by one of skill in the art that the stand may be easily slidably located and removed from either of the bases as shown in FIGS. 4 and 5, as well as on a base wherein the top of the base has a plurality of depressions in a shape complementary to the shape of the base 154 so that the stand may be slidably positioned within the depressions.

In another embodiment, the base may be as shown in FIG. 5. In this embodiment, the base 120 is not in the form of a box with an open front but rather has a slab configuration. In yet another embodiment, the top of the base may have several grooves in the form of depressions wherein each depression can receive a complementary shaped base provided on the bottom of each support.

FIG. 3 is a cross-sectional view of a portion of the stand shown in FIG. 2 taken along line 3—3. FIG. 3 shows the dimension of an aperture formed in the crosspiece of the stand.

In a preferred embodiment, the stands and base are formed of a plastic, acrylic resin or a plastic consisting essentially of polymerized methyl methacrylate such as LUCITE™ or polystyrene.

It should be understood that a wide range of changes and modifications can be made to the embodiments described above. It is therefore intended that the foregoing description illustrates rather than limits this invention, and that it is the following claims, including all equivalents, which defme this invention.

What is claimed:

1. A jewelry holder comprising:

a. a base having a plurality of grooves therein, each groove having a groove height and a groove width, with said height being smaller than said width;

b. a plurality of separate stands, each stand having a base which includes a base height and a base width, in which the base height is smaller than the base width and in which said base width substantially corresponds in size to a respective one of said groove widths, each base being received in a respective one of said grooves, vertical supports extending upwardly from each base, and at least one crosspiece extending between respective said supports, apertures being located in said crosspiece.

2. The jewelry holder according to claim 1 wherein the base is a box that includes:

a. a top spaced from a bottom, the top having the plurality of grooves therein;

b. a first side wall opposite and spaced from a second side wall each of the first and second side walls joining the top and bottom; and c. a front opposite and spaced from a rear wall such that the rear wall is substantially normal to the first and second side walls and the front defines an opening to slidably receive a drawer.

3. The jewelry holder according to claim 1 wherein the plurality of grooves extend across the top of the box in parallel.

4. The jewelry holder according to claim 1 further comprising a plurality of crosspieces extending between respective said supports.

5. The jewelry holder according to claim 1 wherein each of the plurality of stands is self-supporting when removed from the base.

6. The jewelry holder according to claim 1 wherein the base and plurality of stands are formed of an acrylic resin.

7. The jewelry holder according to claim 1 wherein the base and plurality of stands are formed of polystyrene.

8. The jewelry holder according to claim 1 wherein the base and plurality of stands are formed of an acrylic resin consisting essentially of polymerized methyl methacrylate.

9. The jewelry holder according to claim 1 further comprising a second crosspiece extending between respective supports for each of the plurality of separate stands wherein the second crosspiece is spaced apart from the at least one crosspiece.

* * * * *

UNITED STATES PATENT AND TRADEMARK OFFICE

CERTIFICATE OF CORRECTION

PATENT NO. : 5,762,184
DATED : June 9, 1998
INVENTOR(S) : Lor Greiner

It is certified that error appears in the above-identified patent and that said Letters Patent is hereby corrected as shown below:

Title page,
Column 2,
After line 12, under "OTHER PUBLICATIONS", please insert -- Hand drawing of a Jewelry Box, one page (date known) --.

Item [56],
Insert the following,

U.S. PATENT DOCUMENTS

| | | |
|---|---|---|
| -- 2559289 | 7/1951 | Eisen et al. |
| 2714443 | 8/1955 | Kuvin |
| 3406821 | 10/1968 | Weissberg |
| 3606007 | 9/1971 | Huston, jr. |
| 4420084 | 12/1983 | Whelan |
| 4746009 | 5/1988 | Liberman |
| 4848585 | 7/1989 | Snyder |
| 4811996 | 3/1989 | Hansson |

FOREIGN PATENT OR PUBLISHED FOREIGN PATENT APPLICATION

| | | |
|---|---|---|
| 411236 | 6/1934 | United Kingdom -- |

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*